US007581989B1

(12) United States Patent
Wheatley

(10) Patent No.: US 7,581,989 B1
(45) Date of Patent: Sep. 1, 2009

(54) MULTI-PIN ELECTRICAL CONNECTOR

(75) Inventor: William Wheatley, Rochester, NY (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 12/038,969

(22) Filed: Feb. 28, 2008

(51) Int. Cl.
*H01R 13/40* (2006.01)

(52) U.S. Cl. ..... 439/589; 439/272; 439/521

(58) Field of Classification Search ..... 439/589, 439/272, 521
See application file for complete search history.

(56) References Cited

U.S. PATENT DOCUMENTS 5,203,723 A * 4/1993 Ritter ..... 439/589
6,506,083 B1 * 1/2003 Bickford et al. ..... 439/736
6,582,251 B1 * 6/2003 Burke et al. ..... 439/589
7,249,971 B2 * 7/2007 Burke et al. ..... 439/589
7,442,081 B2 * 10/2008 Burke et al. ..... 439/589

* cited by examiner

*Primary Examiner*—Truc T Nguyen
(74) *Attorney, Agent, or Firm*—Darby & Darby PC; Robert J. Sacco

(57) ABSTRACT

An electrical pin field (200) includes a gasket (312), a support member (204) and a plurality of electrically conductive pins (202). The molded member has a main body (320) with a groove (310) formed therein. The groove is sized and shaped for receiving the gasket. The main body has a first and second retaining portion (316, 318) for retaining the gasket within the groove. The second retaining portion can have a chamfered edge (314) with a chamfered angle between fifteen and seventy degrees. The electrically conductive pins are integrated within the molded member.

19 Claims, 4 Drawing Sheets

MULTI-PIN ELECTRICAL CONNECTOR

BACKGROUND OF THE INVENTION

1. Statement of the Technical Field

The invention concerns multi-pin electrical connectors.

2. Background

There are many multi-pin connectors known in the art for joining electrical circuits together. The multi-pin connectors are typically cable mount connectors or board level connectors. Such multi-pin connectors include, but are not limited to, a multi-pin circular connector having a high pin count and a small size. The multi-pin circular connector includes a male connector (or plug) and a female connector (or jack). The male connector is comprised of an electrical pin field encompassed by a housing formed of a wrought material. The term "wrought" as used herein means that a material is forged into a desired form via a hammering process, a twisting process, a bending process, a pressing process and/or other such processes. The electrical pin field is formed of a rear (or bottom) dielectric having electrically conductive pins coupled thereto and a front (or top) dielectric having the electrically conductive pins inserted therethrough. The female connector is comprised of electrically conductive fixed contact field sized and shaped for receiving the electrically conductive pins of the male connector. When the electrically conductive pins are received by the fixed contact field, electrical interconnections are made between two or more electrical circuits.

A perspective view of a conventional electrical pin field 100 is provided in FIG. 1. It should be noted that the electrical pin field 100 has the front (or top) dielectric removed therefrom for clarity. As shown in FIG. 1, the electrical pin field 100 is comprised of a rear (or bottom) dielectric having electrically conductive contacts (not shown). The electrical pin field 100 is also comprised of contact springs and a circular flat gasket with apertures sized and shaped for receiving the contact springs. The contact springs are generally soldered to the electrically conductive contacts (not shown). The circular flat gasket is disposed on the rear (or bottom) dielectric. The electrical pin field is further comprised of electrically conductive pins and pin o-rings. The electrically conductive pins are generally soldered to the contact springs. The pin O-rings are disposed on the electrically conductive pins. The front (or top) dielectric (not shown) has apertures sized and shaped for receiving the electrically conductive pins. The front (or top) dielectric (not shown) is disposed on the circular flat gasket with apertures sized and shaped for receiving the contact springs.

As should be understood by those having ordinary skill in the art, in a typical application, the assembled electrical pin field 100 is coined into a multi-pin connector housing (not shown). Multi-pin connector housings are well known to those skilled in the art, and therefore will not be described in herein. The term "coined" as used herein refers to a process of deflecting (or displacing) a material via a mechanical force to captive and/or retain the electrical pin field therein. It should be noted that the housing material is coined (or displaced) approximately ninety degrees (90°). During this coining process, the circular flat gasket expands radially so as to form a seal between the electrical pin field 100 and the multi-pin connector housing (not shown). This seal is an environmental seal configured to prevent moisture from seeping into the electrical pin field 100.

The electrical pin field 100 is known to suffer from certain drawbacks. For example, the electrical pin field 100 is comprised of numerous hand-assembled components. Such hand-assembled components include, but are not limited to, the contact springs, the electrically conductive pins, the flat gasket, the pin O-rings and the top insulator. Consequently, the assembly of the electrical pin field 100 is labor intensive, skill intensive, and costly. Also, the multi-pin connector housing (not shown) is coined (or displaced) approximately ninety degrees (90°), which is a relatively large amount of displacement. Such a ninety degree (90°) displacement can generally only be accomplished using a housing comprising a malleable wrought material. Wrought materials are more expensive as compared to other types of housing material, such as essentially unmalleable materials (e.g., cast materials). Furthermore, the seal formed by the radially expanded flat gasket tends to fail over time, and therefore provides an unreliable seal. This failure is due to the gasket stress relieving of the apertures formed in the flat gasket.

In view of the forgoing, there remains a need for an electrical pin field having a design that reduces labor and skill intensity, as well as costs associated with the assembly of the electrical pin field. There also remains a need for an electrical pin field that enables an improved coining process. There is further a need for an electrical pin field that provides an improved seal between the electrical pin field and a multi-pin connector housing.

SUMMARY OF THE INVENTION

This Summary is provided to comply with 37 C.F.R. §1.73, requiring a summary of the invention briefly indicating the nature and substance of the invention. It is submitted with the understanding that it will not be used to interpret or limit the scope or meaning of the claims.

The invention concerns an electrical pin field. The electrical pin field is comprised of a gasket, a dielectric and two or more electrically conductive pins. The dielectric comprises a support member having a main body with a groove sized and shaped for receiving the gasket. The main body also has a first and second retaining portion sized and shaped for retaining the gasket within the groove. The second retaining portion advantageously has a chamfered edge with a chamfered angle less than ninety degrees ($\theta<90°$), such as a chamfered angle between fifteen and seventy degrees (15°-70°). The electrically conductive pins are integrated within the support member. The term "integrated" as used herein means that an entire surface of an electrically conductive pin is in direct contact with a material forming the support member. It should be noted that a conventional pin field includes electrically conductive pins that are soldered to a support member.

According to an aspect of the invention, the electrically conductive pins can be bias ball probes. Each of the electrically conductive pins can have a front end portion, a back end portion, and a main body. The main body can have an angled top portion and at least one indent formed therein. The angled top portion keeps a vertical axis of the electrically conductive pin perpendicular to a plane defined by an injection mold during a molding process. The indent securely seals the electrically conductive pin to the support member during the molding process. The main body is integrated within the support member. The front end portion extends beyond a first surface of the support member. Similarly, the back end portion extends beyond a second surface of the support member that is opposed from the first surface.

According to another aspect of the invention, the support member can be further comprised of at least one protruding guide member disposed on a surface of the main body so that it protrudes away from the surface. The protruding guide member can be a solid structure having a cylindrical shape. The protruding guide member assists in an insertion of the electrical pin field into a housing (not shown). The protruding guide member ensures that the electrical pin field is placed in a desired orientation within the housing (not shown).

According to yet another aspect of the invention, the support member can be comprised of a protruding portion sized and shaped for preventing the electrical pin field from rotating in the housing (not shown). The protruding portion can have two or more cavities formed therein. The cavities can be sized and shaped for protecting the electrically conductive pins from over deflection when a pushing force is applied thereto.

BRIEF DESCRIPTION OF THE DRAWINGS

Embodiments will be described with reference to the following drawing figures, in which like numerals represent like items throughout the figures, and in which.

DETAILED DESCRIPTION

Figure 2:
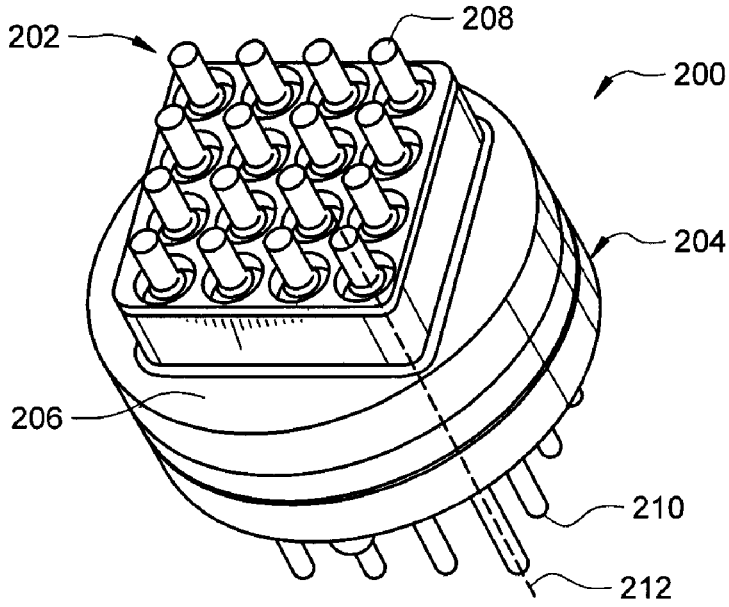
FIG. 2 is a perspective view of an electrical pin field of a multi-pin connector that is useful for understanding the invention.

FIG. 2 is a perspective view of an electrical pin field 200 that is useful for understanding the invention. The electrical pin field 200 is generally used in multi-pin connector systems. The electrical pin field 200 is shown generally by a plurality of electrically conductive pins 202 integrated or integrally molded within a support member 204. As shown in FIG. 2, the electrical pin field 200 is comprised of sixteen (16) regularly spaced electrically conductive pins 202. However, the invention is not limited in this regard. For example, the electrical pin field 200 can include any number of electrically conductive pins in any arrangement selected in accordance with a particular multi-pin connector application.

Figure 1:
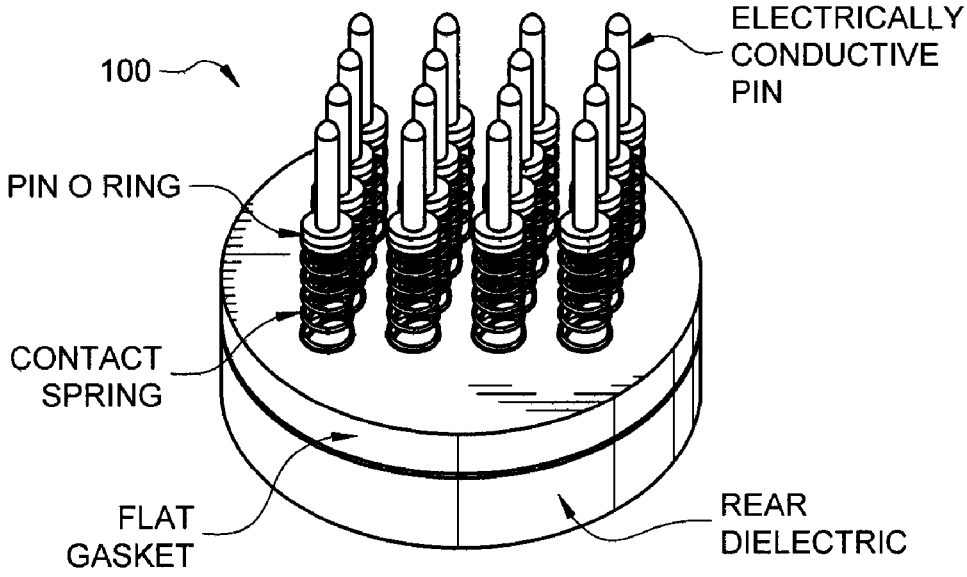
FIG. 1 (Prior Art)
FIG. 1 is a perspective view of an electrical pin field of a conventional multi-pin circular connector.

Referring again to FIG. 2, the electrically conductive pins 202 are of the same type and have a cylindrical shape. For example, the electrically conductive pins 202 comprise bias ball probes available from IDI Corporation of Kansas City, Kans. A bias ball probe includes a chamber with a spring, an inclined plane and a ball disposed therein. When the bias ball probe is actuated, the spring applies a force on the inclined plane. In turn, the inclined pane applies a pushing force on the ball so that the ball rolls against an internal surface of the chamber. In effect, the bias ball probe provides a more robust electrical connection between a front end portion 208 of the pin assembly and the back end portion 210 of the pin assembly as compared to the conventional pin field 100 described above (in relation to FIG. 1). However, the invention is not limited in this regard.

Referring again to FIG. 2, the support member 204 securely retains the electrically conductive pins 202 in a predefined position. In this regard, it should be understood that the electrically conductive pins 202 are arranged in a parallel type configuration. Each of the electrically conductive pins 202 is also arranged so that its vertical axis 212 is generally perpendicular to a plane defined by a surface 206 of the support member 204.

The support member 204 can be a single piece molded component having electrically conductive pins 202 integrated therein. The support member 204 is generally formed from a dielectric material. Such dielectric materials include, but are not limited to, low shrink rate liquid crystal polymers, low shrink rate rubbers and low shrink rate plastics. The support member 204 can be formed utilizing any suitable process known in the art. Such processes include, but are not limited to, molding processes and deposition-etch back processes.

Figure 8:
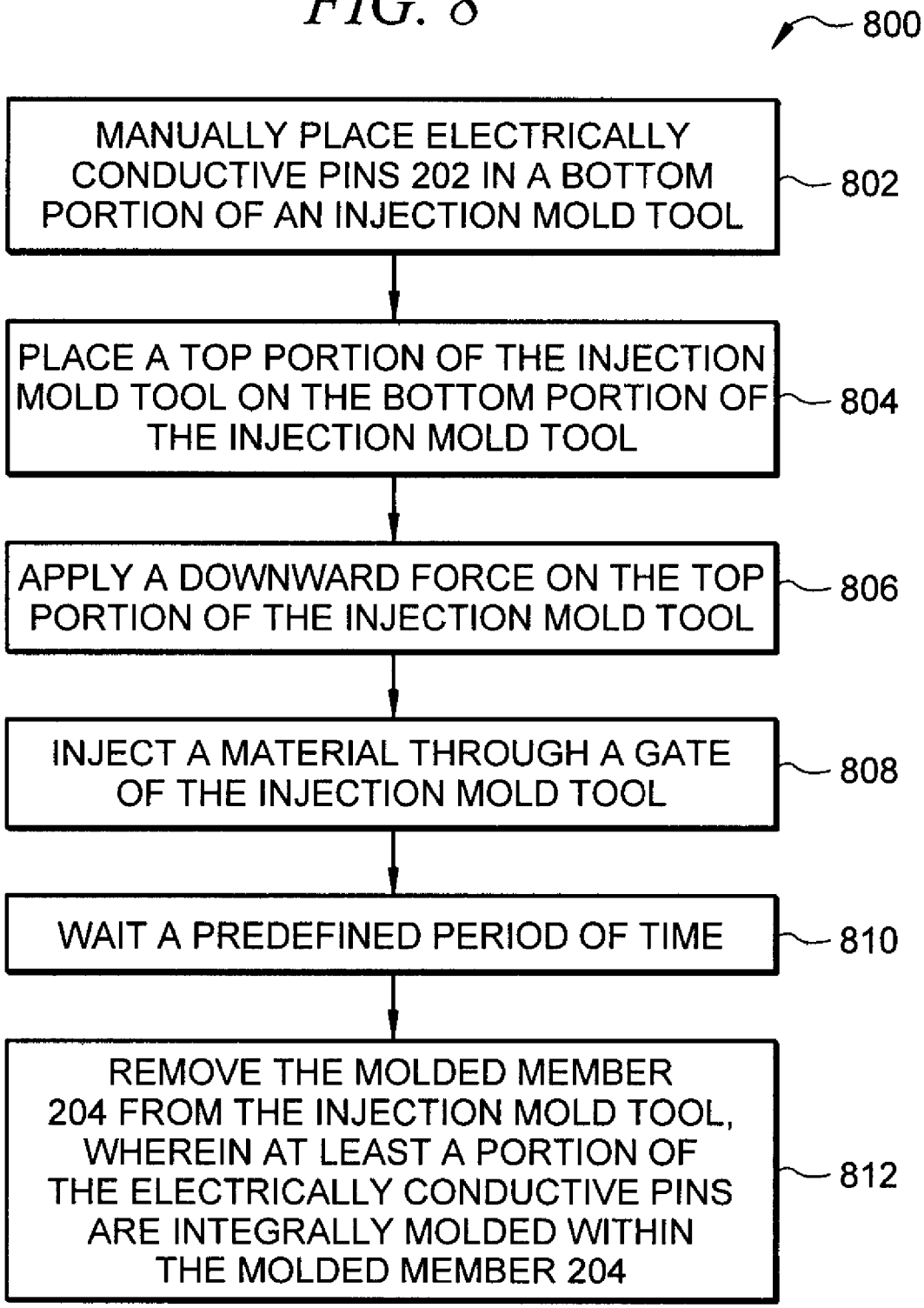
FIG. 8 is a flow of diagram of an injection molding process used to make the electrical pin field of FIG. 2.

According to an embodiment of the invention, the support member 204 is formed utilizing an injection molding process. A flow diagram of an exemplary injection molding process 800 is provided in FIG. 8. As shown in FIG. 8, the injection molding process 800 generally involves the steps of: (802) manually placing the electrically conductive pins 202 in a bottom portion of an injection mold tool; (804) placing a top portion of the injection mold tool on the bottom portion of the injection mold tool; (806) applying a downward force on the top portion of the injection mold tool; (808) injecting a material through a gate of the injection mold tool; (810) waiting a pre-defined period of time; and (812) removing the support member 204 from the injection mold tool. At least a portion of the electrically conductive pins 202 are integrated or integrally molded within the support member 204. The invention is not limited in this regard and may be formed using any other suitable process.

Figure 3A:
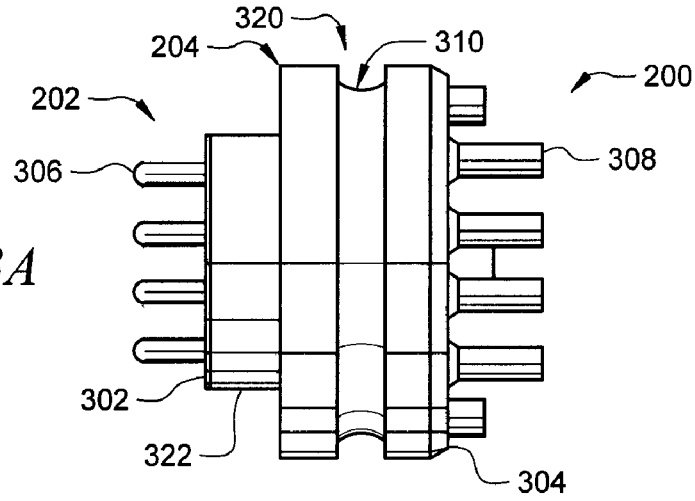
FIG. 3A is a side view of the electrical pin field of FIG. 2.
Figure 3B:
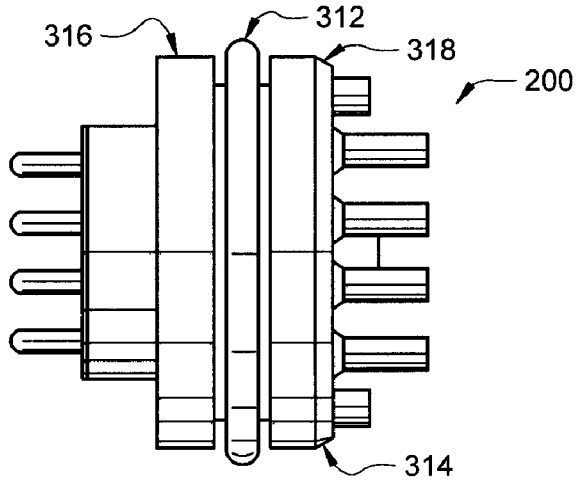
FIG. 3B is a side view of the electrical pin field of FIG. 2.

Referring now to FIGS. 3A-3B, there are provided side views of the electrical pin field 200. As shown in FIGS. 3A-3B, the electrically conductive pins 202 are partially disposed in the support member 204. In effect, a first end portion (or contact portion) 306 of each pin 202 extends beyond a first surface 302 of the support member 204. Similarly, a second end portion (or a solder portion) 308 of each pin 202 extends beyond a second surface 304 of the support member 204. The first end portions 306 are provided to mate with electrically conductive contacts of a female connector (not shown) for joining two or more electrical circuits together. The second end portions 308 can have a shape suitable for enabling the connection of wires to the pins 202 via a soldering process. Such shapes include, but are not limited to, solid cylindrical shapes, solid square turret shapes, and cup shapes. Soldering processes are well known to those skilled in the art, and therefore will not be described in detail herein.

The support member 204 shown is comprised of a main body member 320 and a protruding end member 322. The main body member 320 has a groove 310, a first retaining portion 316 and a second retaining portion 318. The groove 310 is sized and shaped for receiving a gasket 312 having a loop-like shape and a central aperture. The retaining portions 316, 318 are sized and shaped for preventing the gasket 312 from being dislodged from the groove 310.

According to an embodiment of the invention, the gasket is an o-ring gasket. In such a scenario, the groove 310 is an o-ring groove sized and shaped to receive the o-ring gasket. Still, the invention is not limited in this regard.

The second retaining portion 318 is advantageously comprised of a chamfered edge 314. The chamfered edge 314 generally enables an improved coining process by reducing the amount of deflection required to captivate the electrical pin field 200 in a multi-pin connector housing (not shown). Multi-pin connector housings are well known to those skilled in the art, and therefore will not be described in great detail herein. However, it should be understood that any housing suitable for a particular multi-pin connector application can generally be used without limitation.

As described above, the phrase "coining process" as used herein refers to a process of deflecting (or displacing) a housing material via a mechanical force to captive and/or retain the electrical pin field 200 therein. It should be noted that the chamfered edge 314 enables a displacement of the housing material by an amount substantially less than ninety degrees (90°). More particularly, the chamfered edge 314 can for example enable a displacement of the housing material by fifteen to seventy degrees (15°-70°). Such a displacement can be accomplished using a housing (not shown) comprising a malleable wrought material as well as other less expensive materials. Such less expensive materials include, but are not limited to, cast materials and other less malleable materials.

Referring again to FIGS. 3A-3B, the gasket 312 is configured to provide a piston seal between the electrical pin field 200 and a multi-pin connector housing (not shown). According to an embodiment of the invention, the gasket 312 is selected to comprise silicon having a hardness between fifty (50) to ninety (90) durometers. Still, the invention is not limited in this regard. It should be understood that this piston seal is an environmental seal configured to prevent moisture from seeping into the electrical pin field 200. It should also be understood that the piston seal formed by the gasket 312 is more reliable than the seal formed by the flat gasket of a conventional electrical pin field 100. Stated differently, the piston seal generally lasts longer as compared to the conventional flat gasket seal described above in relation to FIG. 1.

Figure 4:
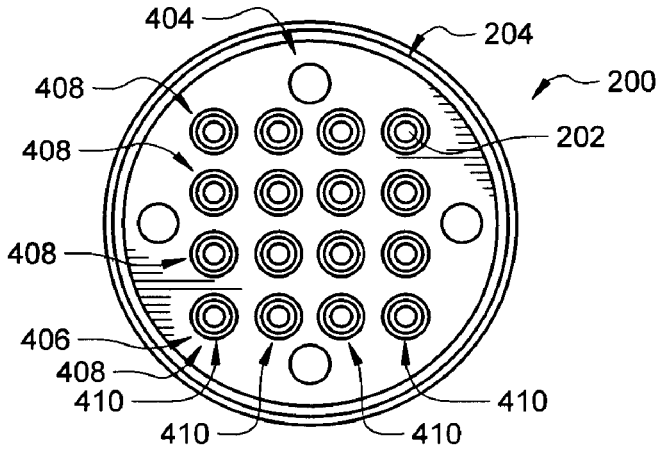
FIG. 4 is a top view of the electrical pin field of FIG. 2.

Referring now to FIG. 4, there is provided a top view of the electrical pin field 200. As shown in FIG. 4, the electrically conductive pins 202 are arranged in a grid pattern 406. The grid pattern 406 has a plurality of parallel rows 408 and a plurality of parallel columns 410. Each of the rows 408 and columns 410 includes numerous electrically conductive pins 202 that are equally spaced apart. For example, if the electrical pin field 200 is to be used in a nine (9) pin electrical connector application, then the electrical pin field 200 is comprised of three (3) rows 408 having three (3) equally spaced apart electrically conductive pins 202. Similarly, each of the columns 410 includes three (3) equally spaced apart electrically conductive pins 202. As described above, the invention is not limited with respect to the number or arrangement of the electrically conductive pins 202.

Referring again to FIG. 4, the support member 204 also includes one or more protruding guide members 404. The protruding guide members 404 assist in the insertion of the support member 204 into a multi-pin connector housing (not shown). The protruding members 404 also ensure that the electrical pin field 200 is placed in a proper orientation within the multi-pin connector housing (not shown). The protruding guide members 404 can further ensure that the support member 204 is spaced a pre-defined distance from a surface of a printed circuit board (PCB). In one embodiment, the protruding guide members 404 have a solid cylindrical shape. Still, the invention is not limited in this regard. For example, the protruding guide members 404 can have any solid or tubular shape selected in accordance with a particular electrical pin field 200 application.

Figure 5:
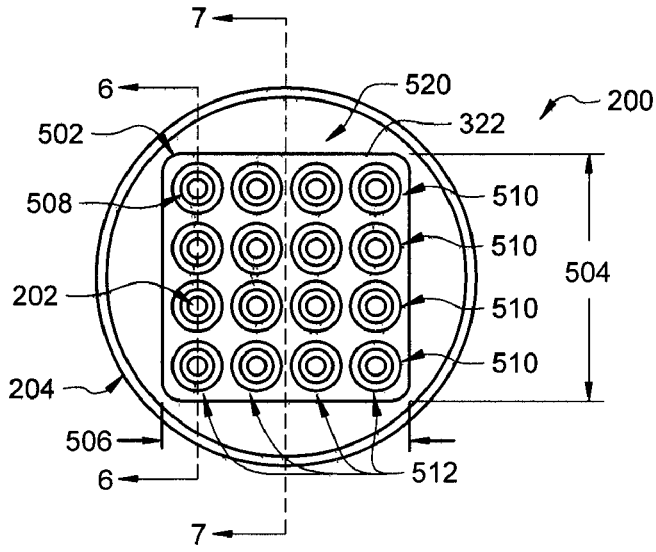
FIG. 5 is a bottom view of the electrical pin field of FIG. 2.

Referring now to FIG. 5, there is provided a bottom view of the electrical pin field 200. As shown in FIG. 5, the support member 204 is comprised of a protruding member 322. The protruding member 322 has a rectangular shape with rounded edges 502. The protruding member 322 is provided to ensure that the electrical pin field 200 remains in a selected or optimal position within a multi-pin connector housing (not shown). Stated differently, the protruding member 322 is provided to guarantee that each of the electrically conductive pins 202 mate with the respective electrically conductive socket of a female connector (not shown). More particularly, the protruding member 322 provides a means for preventing the electrical pin field 200 from rotating or spinning inside a multi-pin connector housing (not shown).

Referring again to FIG. 5, the protruding member 322 has a pre-defined width 506 and length 504. For example, the width 506 and length 504 are selected to have the same value. In one particular embodiment, each of the dimensions 504, 506 is selected to have a value falling within the range of 0.348 inch to 0.352 inch. However, other width and length dimensions may be used.

The protruding member 322 also has a plurality of cavities 508 formed therein. The cavities 508 are provided to protect the electrically conductive pins 202 from over deflection when a pushing force is applied thereto. The cavities 508 are arranged in a grid pattern 520. The grid pattern 520 includes a plurality of parallel rows 510 and a plurality of parallel columns 512. Each of the rows 510 and columns 512 shown includes numerous cavities 508 that are equally spaced apart. For example, if the electrical pin field 200 is to be used in a nine pin electrical connector application, then the electrical pin field 200 can comprise three rows 510 having three equally spaced apart cavities 508. Similarly, each of the columns 512 shown includes three equally spaced apart cavities 508. Still, the invention is not limited in this regard.

Figure 6:
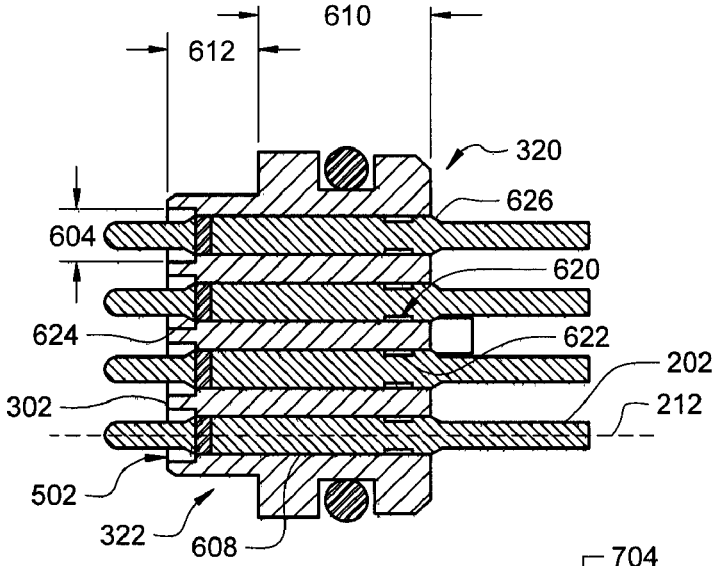
FIG. 6 is a cross-sectional view of the electrical pin field taken along line 6-6 of FIG. 4.

Referring now to FIG. 6, there is provided a cross sectional view of the electrical pin field 200 taken along line 6-6 of FIG. 5. As shown in FIG. 6, the main body member 320 is comprised of a first surface 302 with the cavities 502 formed therein. Each of the cavities 502 has a pre-selected diameter 604. For example, each of the diameters 604 can be selected to have a value equal to 0.072 inches. Still, the invention is not limited in this regard. Notably, the cavities 502 are provided to protect the electrically conductive pins 202 from over deflection when a pushing force is applied thereto. As such, the cavities 502 can be designed in accordance with a particular electrical pin field 200 application.

The main body member 320 has a pre-selected height 610. For example, in one present embodiment, the height 610 is selected to have a value falling within the range of 0.212 inch to 0.228 inch. Still, the invention is not limited in this regard. Similarly, in one present embodiment, the protruding member 322 has a pre-selected height 612. For example, the height 612 is selected to have a value falling within the range of 0.102 inch to 0.118 inch. Still, the invention is not limited in this regard.

As shown in FIG. 6, each of the electrically conductive pins 202 has a main body 624 with an angled top portion 626 and at least one indented (or recessed) portion 620. The angled top portion 626 can help keep the vertical axis 212 of the electrically conductive pin 202 perpendicular to a plane defined by an injection mold tool (not shown) in the case of a molding process. The indented portions 620 can assist in sealing the electrically conductive pins 202 to the molding material during a molding process. The indented portion 620 can have any shape selected in accordance with a particular electrical pin field 200 application. For example, the indented portion 620 can have a surface 622 that is perpendicular to the vertical axis 212 of the respective electrically conductive pin 202. Alternatively, the indented portion 620 can have a sloped surface 622 that is set at an angle with respect to the vertical axis 212 of the respective electrically conductive pin 202. Notably, such a sloped surface configuration generally has improved environmental sealing capabilities as compared to the non-sloped configuration.

Figure 7:
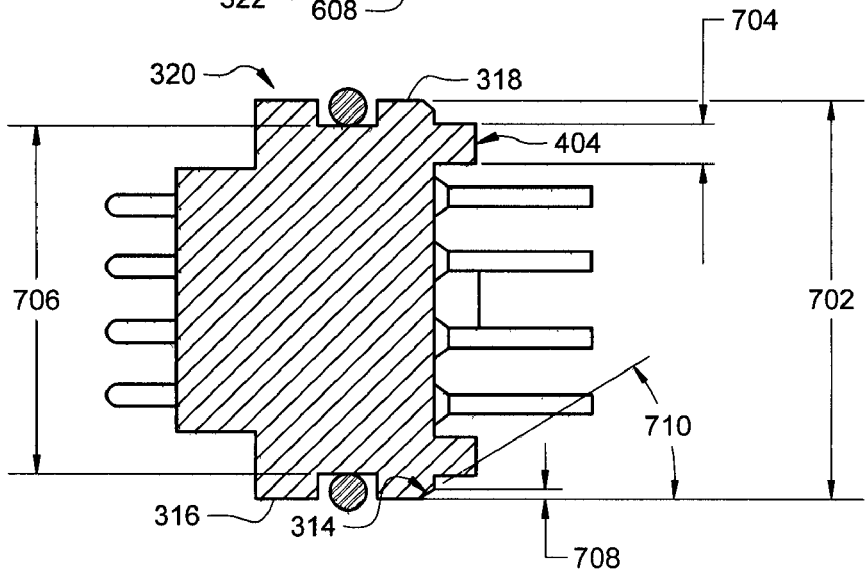
FIG. 7 is a cross-sectional view of the electrical pin field taken along line 7-7 of FIG. 4.

Referring now to FIG. 7, there is provided a cross sectional view of the electrical pin field 200 taken along line 7-7 of FIG. 5. As shown in FIG. 7, each of the first and second retaining portions 316, 318 of the support member 204 has a preselected diameter 702. For example, in one present embodiment, the diameter 702 is selected to have a value falling within the range of 0.522 inch to 0.524 inch. Still, the invention is not limited in this regard. Each of the protruding guide members 404 also has a diameter 704 selected in accordance with a particular pin field application. For example, in one present embodiment, the diameter 704 is selected to have a value falling within the range of 0.192 inch to 0.208 inch. Still, the invention is not limited in this regard.

The portion of the main body member 320 having the groove 310 formed therein has a diameter 706. The diameter 706 is selected in accordance with a particular groove 310 application. For example, in one present embodiment, the diameter 706 is selected to have a value falling within the range of 0.452 inch to 0.456 inch. Still, the invention is not limited in this regard. The chamfered edge 314 of the main body member 320 is selected to have a width 708 and a chamfered angle 710. The chamfered angle 710 can have a value between fifteen and seventy degrees (15°-70°). According to a particular embodiment of the invention, the width 708 is selected to have a value falling within the range of 0.010 inch to 0.020 inch. The chamfered angle 710 is selected to be thirty degrees (300). Still, the invention is not limited in this regard.

All of the apparatus, methods and algorithms disclosed and claimed herein can be made and executed without undue experimentation in light of the present disclosure. While the invention has been described in terms of preferred embodiments, it will be apparent to those of skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those skilled in the art are deemed to be within the spirit, scope and concept of the invention as defined.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the following claims.

I claim:

1. An electrical pin field, comprising:

a dielectric comprising a support member having a main body including a top surface, bottom surface and a plurality of through-holes formed therein, a groove sized and shaped for receiving a gasket, and a protruding portion extending from said top surface, sized and shaped for preventing said electrical pin field from rotating in a housing, said main body having a first and second retaining portion annually disposed on an outer periphery thereof for retaining said gasket within said groove; and a plurality of electrically conductive pins disposed within said plurality of through-holes so as to be integrated within said support member, each of said plurality of electrically conductive pins configured to deflect in a direction toward said main body when a pushing force is applied thereto;

wherein said plurality of electrically conductive pins include a first portion extending away from said top surface and a second portion extending away from said bottom surface, and said protruding portion having a plurality of non-through hole cavities formed therein, each of said plurality of non-through hole cavities axially aligned with respective ones of said through-holes and formed around a respective pin of said plurality of electrically conductive pins, said plurality of non-through hole cavities having larger diameters as compared to said plurality of through-holes.

2. The electrical pin field according to claim 1, wherein said second retaining portion has a chamfered edge.

3. The electrical pin field according to claim 2, wherein said chamfered edge has a chamfered angle between fifteen and seventy degrees.

4. The electrical pin field according to claim 1, wherein said plurality of electrically conductive pins comprise bias ball probes.

5. The electrical pin field according to claim 1, wherein said gasket has a loop shape and consists of a central aperture.

6. The electrical pin field according to claim 1, wherein said plurality of electrically conductive pins have a front end portion, a back end portion, and a main body with an angled top portion and at least one indent formed in said main body.

7. The electrical pin filed according to claim 1, wherein said support member is further comprised of at least one protruding guide member disposed on a surface of said main body so that it protrudes outward from the surface.

8. The electrical pin field according to claim 6, wherein said main body of said pin is integrated within said support member, said front end portion extending beyond said top surface of said support member, and said back end portion extending beyond a bottom surface of said support member that is opposed from said top surface.

9. The electrical pin field according to claim 7, wherein said at least one protruding guide member is a solid structure having a cylindrical shape.

10. An electrical pin field, comprising:

a dielectric comprising a support member having a main body including a top surface, bottom surface and a plurality of through-holes formed therein, an o-ring groove sized and shaped for receiving an o-ring gasket, a protruding portion extending from said top surface, sized and shaped for preventing said electrical pin field from rotating in a housing;

said main body having a first and second retaining portion annually disposed on an outer periphery thereof for retaining said o-ring gasket within said o-ring groove, said second retaining portion comprising a chamfered edge having a chamfered angle between fifteen and seventy degrees; and a plurality of electrically conductive pins disposed within said plurality of through-holes so as to be integrated within said support member, each of said plurality of electrically conductive pins configured to deflect in a direction toward said main body when a pushing force is applied thereto;

wherein said plurality of electrically conductive pins include a first portion extending away from said top surface and a second portion extending away from said bottom surface, and said protruding portion having a plurality of non-through hole cavities formed therein, each of said plurality of non-through hole cavities axially aligned with respective ones of said through-holes and formed around a respective pin of said plurality of electrically conductive pins, said plurality of non-through hole cavities having larger diameters as compared to said plurality of through-holes.

11. The electrical pin field according to claim 10, wherein said plurality of electrically conductive pins comprise bias ball probes.

12. The electrical pin field according to claim 10, wherein said plurality of electrically conductive pins have a front end portion, a back end portion, and a main body with an angled top portion and at least one indent formed in said main body.

13. The electrical pin field according to claim 12, wherein said main body of said pin is integrated within said support member, said front end portion extending beyond said top surface of said support member, and said back end portion extending beyond a bottom surface of said support member that is opposed from said top surface.

14. A method for making an electrical pin field, comprising the steps of:

constructing a mold sized and shaped to form an electrical pin field including a support member having a main body including a top surface, a bottom surface and a plurality of through-holes formed therein, and a protruding portion extending from said top surface, sized and shaped for preventing said electrical pin field from rotating in a housing, and having a plurality of non-through hole cavities formed therein, each of said plurality of non-though hole cavities axially aligned with respective ones of said through-holes and has a larger diameter as compared to each of said plurality of through-holes;

disposing a plurality of electrically conductive pins in a pre-defined arrangement within said mold, each of said plurality of electrically conductive pins configured to deflect in a direction toward a center thereof when a pushing force is applied thereto;

forming said support member by injecting a heated molding material into said mold; and removing said support member from said mold after a temperature of said molding material decreases, wherein said support member has said plurality of electrically conductive pins disposed within said plurality of through-holes so as to be integrated therein, and each of said non-through hole cavities is formed around a respective pin of said plurality of electrically conductive pins.

15. The method according to claim 14, wherein said plurality of electrically conductive pins are bias ball probes.

16. The method according to claim 14, wherein said mold is further sized and shaped to form a support member having a groove sized and shaped for receiving a gasket.

17. The method according to claim 16, wherein said mold is further sized and shaped to form a support member comprising a main body having a first and second retaining portion for retaining said gasket within said groove.

18. The method according to claim 16, wherein said mold is further sized and shaped to form a chamfered edge on said second retaining portion having a chamfered angle between fifteen and seventy degrees.

19. The method according to claim 16, wherein said mold is configured for integrating each electrically conductive pin of said plurality of electrically conductive pins within said support structure so that a first portion of each electrically conductive pin extends outward from said top surface and a second portion of each electrically conductive pin extends outward from said bottom surface.

* * * * *

UNITED STATES PATENT AND TRADEMARK OFFICE
Certificate

Patent No. 7,581,989 B1 Patented: September 1, 2009

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: William Wheatley, Rochester, NY (US); and Robert G. Bray, Webster, NY (US).

Signed and Sealed this Fifteenth Day of November 2011.

RENEE S. LUEBKE
*Supervisory Patent Examiner*
Art Unit 2832
Technology Center 2800